United States Patent [19]

O'Connor

[11] Patent Number: 4,813,575

[45] Date of Patent: Mar. 21, 1989

[54] NON-REFILLABLE VALVE FOR PRESSURIZED CONTAINERS

[75] Inventor: Robert F. O'Connor, Greenville, R.I.

[73] Assignee: Amtrol Inc., West Warwick, R.I.

[21] Appl. No.: 102,329

[22] Filed: Sep. 29, 1987

[51] Int. Cl.[4] ..... B65D 47/02

[52] U.S. Cl. ..... 222/147; 222/3; 251/82

[58] Field of Search ..... 222/3, 147; 251/82; 137/315, 533.21

[56] References Cited

U.S. PATENT DOCUMENTS

| | | | |
|---|---|---|---|
| Re. 25,807 | 6/1965 | Raehs et al. | 239/579 |
| 325,989 | 9/1885 | Stearns . | |
| 435,322 | 8/1890 | Richards . | |
| 573,773 | 12/1896 | Fernandes . | |
| 619,966 | 2/1899 | Lanser . | |
| 680,405 | 8/1901 | Aaron . | |
| 680,416 | 8/1901 | Kuhles . | |
| 728,759 | 5/1903 | Pillmore et al. . | |
| 829,619 | 8/1906 | Atkinson et al. . | |
| 871,780 | 11/1907 | Card . | |
| 879,000 | 2/1908 | Pitner . | |
| 909,890 | 1/1909 | Hammerstein . | |
| 998,695 | 7/1911 | Kieser . | |
| 1,051,738 | 1/1913 | Kavanagh . | |
| 1,097,187 | 5/1914 | Pecorella . | |
| 1,104,201 | 7/1914 | Lenzi . | |
| 1,133,042 | 3/1915 | Kull | 152/12 |
| 1,164,014 | 12/1915 | Phillips . | |
| 1,305,747 | 6/1919 | Sechrist . | |
| 1,416,781 | 5/1922 | Bevins . | |
| 1,474,160 | 11/1923 | Nugent . | |
| 1,554,127 | 9/1925 | Roberts . | |
| 1,878,222 | 9/1932 | Wilson . | |
| 2,279,513 | 4/1942 | Hage | 251/121 |
| 2,314,767 | 3/1943 | Burrell | 251/122 |
| 2,368,281 | 1/1945 | Wittenberg | 251/131 |
| 2,372,456 | 3/1945 | Stewart | 137/69 |
| 2,471,383 | 5/1945 | Althouse et al. | 166/1 |
| 2,524,129 | 3/1945 | Klein | 231/144 |
| 2,699,180 | 1/1955 | Frye | 137/539.5 |
| 2,702,179 | 2/1955 | Grunt | 251/340 |
| 2,715,512 | 8/1955 | Miller et al. | 251/148 |

(List continued on next page.)

FOREIGN PATENT DOCUMENTS

| | | |
|---|---|---|
| 798660 | 11/1968 | Canada . |
| 291105 | 9/1913 | Fed. Rep. of Germany . |
| 1425865 | 11/1964 | Fed. Rep. of Germany . |
| 3337197 | 2/1985 | Fed. Rep. of Germany . |
| 439576 | 6/1912 | France . |
| 49363 | 3/1939 | France . |
| 2536818 | 11/1983 | France . |
| 138036 | 10/1979 | German Democratic Rep. . |
| 552293 | 11/1956 | Italy . |
| 4623094 | 12/1967 | Japan . |
| 23468 | 12/1900 | United Kingdom . |
| 29738 | 12/1906 | United Kingdom . |

(List continued on next page.)

*Primary Examiner*—Joseph J. Rolla
*Assistant Examiner*—Gregory L. Huson
*Attorney, Agent, or Firm*—Fisher, Christen & Sabol

[57] ABSTRACT

Non-refillable valve has a housing with a central bore, which has a lower portion that is narrower than its middle portion that in turn is narrower than its upper portion. A side port is present in the lower region of the middle portion. An outlet nozzle is located in the side port. The lower end of the housing sealingly engages the pressure container to provide communication therebetween. The valve stem is rotatably positioned in the upper portion of the central bore. The valve stem contains a vertical bore in its bottom portion. A resilient valve sealing member has a body portion and a top pin which slidably fits in the bore in the valve stem. The sealing member has a top rim portion which has a continuous outer surface and does not have any slots, identations or the like. Also, the body portion does not have any arm or arms, particularly around its periphery. The top rim portion of the sealing member is comprisingly positioned in the upper portion of the central bore when the valve is inactive or being filled. The valve sealing member is pushed into the middle portion via the valve stem when the valve is placed in the active position. The non-compressed top rim of the sealing member is wider than the upper portion of the central bore, which prevents movement of the sealing member back into the upper portion of the central bore. The sealing member engages the seating interface when any refill of the container with pressurized fluid is attempted.

11 Claims, 3 Drawing Sheets

U.S. PATENT DOCUMENTS

| | | | |
|---|---|---|---|
| 2,722,402 | 11/1955 | Crookston | 251/324 |
| 2,747,611 | 5/1956 | Hewitt | 137/622 |
| 2,770,255 | 11/1956 | Goddard | 137/529 |
| 2,830,619 | 4/1958 | Hollander | 137/622 |
| 2,837,110 | 6/1958 | Graybill | 137/327 |
| 2,861,723 | 11/1958 | Cooksley | 222/394 |
| 2,869,764 | 1/1959 | Collins | 222/394 |
| 2,912,999 | 11/1959 | Kersh | 137/512.4 |
| 2,913,749 | 11/1959 | Ayres | 15/139 |
| 2,914,085 | 11/1959 | Mercier | 137/514 |
| 2,917,073 | 12/1959 | Dinkelkamp | 137/495 |
| 2,931,618 | 4/1960 | Franzreb | 251/88 |
| 2,949,243 | 8/1960 | Raehs et al. | 239/579 |
| 2,965,270 | 12/1960 | Soffer et al. | 222/394 |
| 2,965,271 | 12/1960 | Soffer et al. | 222/542 |
| 2,979,067 | 4/1961 | Kern, Jr. et al. | 137/15 |
| 3,054,422 | 9/1962 | Napolitano | 137/509 |
| 3,077,204 | 2/1963 | Bennett et al. | 137/525 |
| 3,089,627 | 5/1963 | Lippig | 222/511 |
| 3,102,489 | 9/1963 | Corsette et al. | 103/42 |
| 3,238,965 | 3/1966 | Masheder | 137/329.05 |
| 3,292,808 | 12/1966 | Greene | 215/11 |
| 3,308,494 | 3/1967 | Licher | 9/317 |
| 3,343,566 | 9/1967 | Luckenbill | 138/43 |
| 3,374,805 | 3/1968 | Trevarrow | 137/525 |
| 3,384,342 | 5/1968 | Passer | 251/357 |
| 3,403,823 | 10/1968 | O'Donnell | 222/153 |
| 3,406,827 | 10/1968 | Follett | 137/39 |
| 3,447,564 | 6/1969 | North et al. | 137/512 |
| 3,472,427 | 10/1969 | Schaefer | 222/396 X |
| 3,516,639 | 6/1970 | Himmelman | 251/257 |
| 3,529,599 | 9/1970 | Folkman et al. | 128/275 |
| 3,534,771 | 10/1970 | Eyerdam et al. | 137/516.25 |
| 3,589,386 | 6/1971 | Chapman et al. | 137/269 |
| 3,589,397 | 6/1971 | Wagner | 137/614.2 |
| 3,601,152 | 8/1971 | Kenworthy | 137/525 |
| 3,669,407 | 6/1972 | Mundt et al. | 251/334 |
| 3,704,813 | 12/1972 | Devol | 222/147 |
| 3,726,309 | 4/1973 | Neubert | 137/528 |
| 3,766,940 | 10/1973 | Mason | 137/460 |
| 3,812,841 | 5/1974 | Isaacson . | |
| 3,830,252 | 8/1974 | Follet . | |
| 3,861,548 | 1/1975 | Bereziat | 215/22 |
| 3,896,835 | 7/1975 | Wicke | 137/75 |
| 3,902,663 | 9/1975 | Elmer | 236/87 |
| 3,970,106 | 7/1976 | Harris | 137/843 |
| 3,985,332 | 10/1976 | Walker | 222/147 X |
| 3,985,332 | 10/1976 | Walker | 251/111 |
| 3,993,099 | 11/1976 | Nightingale | 137/625.48 |
| 4,022,425 | 5/1977 | Govzman et al. | 251/324 |
| 4,027,851 | 6/1977 | Schlotman | 251/172 |
| 4,036,467 | 7/1977 | Dalton | 251/14 |
| 4,072,162 | 2/1978 | Bellehache et al. . | |
| 4,088,301 | 5/1978 | Ehmig | 251/334 |
| 4,137,955 | 2/1979 | Carlson . | |
| 4,158,362 | 6/1979 | Durrett et al. | 128/272 |
| 4,205,690 | 6/1980 | Layton | 128/768 |
| 4,254,792 | 3/1981 | Schädel | 137/240 |
| 4,258,801 | 3/1981 | Poston | 175/65 |
| 4,280,498 | 7/1981 | Jensen | 128/283 |
| 4,286,573 | 9/1981 | Nickel | 126/362 |
| 4,291,689 | 9/1981 | Hay | 128/200.24 |
| 4,307,731 | 12/1981 | Kaufman | 128/766 |
| 4,326,541 | 4/1982 | Eckels | 128/766 |
| 4,328,828 | 5/1982 | Cianci | 137/549 |
| 4,334,537 | 6/1982 | Peterson | 128/275 |
| 4,340,068 | 7/1982 | Kaufman | 128/766 |
| 4,341,330 | 7/1982 | Mascia et al. | 222/401 |
| 4,368,754 | 1/1983 | Roberts | 137/315 |
| 4,369,812 | 1/1983 | Paradis et al. | 137/843 |
| 4,374,583 | 2/1983 | Barrington | 251/324 |
| 4,406,304 | 9/1983 | Vamvakas | 137/544 |
| 4,543,980 | 10/1985 | van der Sanden | 137/315 |
| 4,573,611 | 3/1986 | O'Connor | 222/147 |

FOREIGN PATENT DOCUMENTS

| | | |
|---|---|---|
| 20873 | 5/1916 | United Kingdom . |
| 209821 | 1/1924 | United Kingdom . |
| 883459 | 11/1961 | United Kingdom . |
| 1183760 | 3/1970 | United Kingdom . |
| 2071044 | 9/1981 | United Kingdom . |
| 2088317 | 6/1983 | United Kingdom . |
| 2133502 | 7/1984 | United Kingdom . |

OTHER PUBLICATIONS

*Hannemann, F.,* Technische Information Armaturen, 14 (1979) 3/4, pp. 73 to 78.

*Pinaiewa, E.G.,* Technische Information Armaturen, 7 (1972) 2/4, pp. 15 to19.

Signman, Katalog Prumyslovych Armature, II (1973), pp. 553 and 554 Aerosol Age, (Mar. 1959), pp. 48 and 62.

Aerosol Age, (Dec. 1958), pp. 45, 46 and 101.

Aerosol Age, (Apr. 1960), and ad page.

Aerosol Age, vol. II, No. 4, (Apr. 1966), pp. 35, 38, 45, 46 and 116.

Aerosol Age, (May. 1966), pp. 41, 42, 44, 47, 48, 128 and 129.

Aerosol Report (Aug. 1971) p. 451.

Aerosol Report (Jan. 1975), pp. A32, 57 and 58.

O'Keefe, William, "Check Valves," Power, (Aug. 1976), pp. 25 to 36.

Bulletin (In German) pp. 1 to 9, Figs. 10 to 12–Rec'd Nov. 20, 1978 by Lib. of Congress.

Aerosols: Science and Technology, Interscience Publishers, Inc. NY, pp. 119 and 207 to 211.

FIG. 5
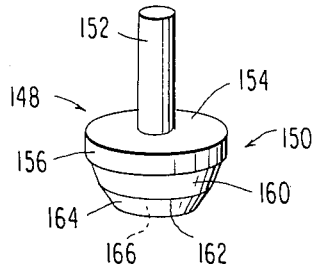
FIG. 6
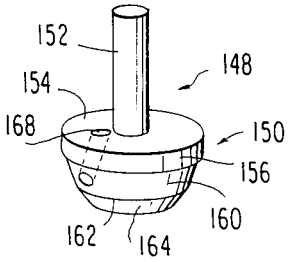
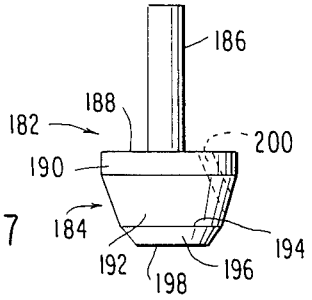
FIG. 7
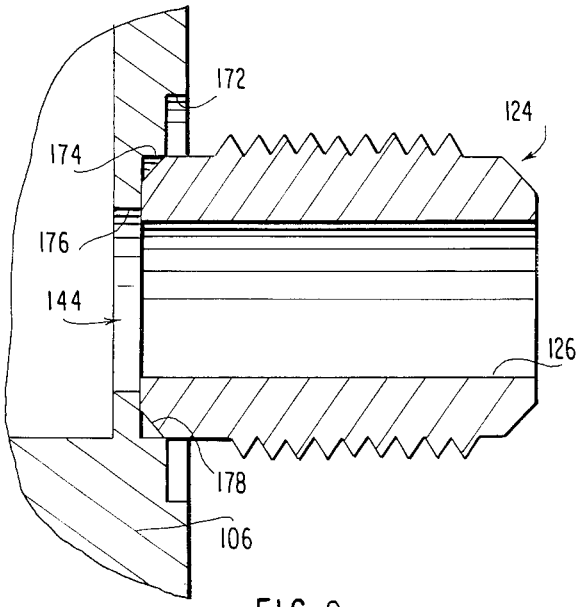
FIG. 8
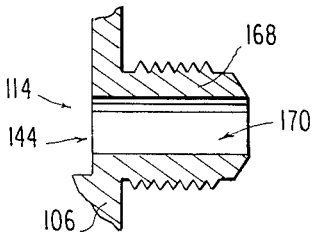
FIG. 9

NON-REFILLABLE VALVE FOR PRESSURIZED CONTAINERS

BACKGROUND OF THE INVENTION

1. Field of the Invention

The invention relates to non-refillable or single use valves for pressurized systems. The valve includes a valve housing mounted on the container, a valve body movable in the housing by means of a handle to allow and prevent release of fluid from the container. A nozzle is provided for venting fluid from the container.

2. Background Art

Pressure tanks or other pressure containers are usually filled under carefully controlled conditions at a charging station and then distributed to various places for use. Unfortunately, the attractive economies of refilling containers at points of use or otherwise repressurizing them under less than carefully supervised conditions has resulted, in the less consequential cases, in the introduction of impurities or inferior refills and, in the more consequential cases, to injurious explosions. The reuse of pressure containers is highly objectionable for many reasons which relate to safety.

U.S. Pat. No. 4,573,611 discloses a non-refillable valve for a pressure container which includes a housing. The housing has a central bore which has a lower portion that is narrower than the middle portion of the central bore and which has an upper portion that is narrower than middle portion of the central bore. A side port is present which communicates with the lower region of the middle portion of the central bore. The lower end of the housing is adapted to sealingly engage the pressure container in a manner which provides communication between the pressure container and the lower portion of the central bore. There is an outlet nozzle, having a bore lengthwise therethrough, which is positioned on the side of the housing which is in communication with the middle portion of the central bore via the side port in the housing. Valve stem means is positioned in the upper portion of the central bore in a rotatable manner which advances the valve stem means back and/or forth in the central bore. A tube is mounted on the internal end of the valve stem means which extends into the middle portion of the central bore. There is also a resilient valve sealing member which has a body portion and an upper flange that extends upwardly and outwardly from the body. A longitudinal passageway is present in the body portion, the bottom portion of the longitudinal passageway not extending through the bottom of the body portion. A vertical post is positioned in the middle of the longitudinal passageway, thereby forming a slot around the vertical post. The post slidingly engaging the tube on the bottom of the valve stem means. The flange portion of the sealing member is compressingly positioned in the upper portion of the central bore when the valve is inactive or being filled. The valve sealing member is pushed into the middle portion by means of the valve stem means when the valve is placed in the active position. The valve sealing member is seated against the interface between the middle and lower portions of the central bore when the valve is closed. The sealing member is positioned in the middle chamber above the seating interface when the valve is used for discharge of the container. The sealing member sealingly engages the seating interface when refill of container with pressurized fluid is attempted.

U.S. Pat. No. 4,543,980 discloses a valve for a pressurized container having a blocking element therein which is adapted to occupy an initial location in which fluid can move in and out of the container past the blocking element. The valve and blocking element are further configured such that the blocking element can be irreversibly moved to a position in which the valve permits escaped of fluid under pressure exerted from the inside of the container, but which automatically closes in response to exposure to an external pressure greater than the pressure inside the container. The blocking element is formed of at least one flexible, radially extending arm whose lateral radius is reduced upon movement of the blocking element from the initial location to the final location. The at least one arm expands within the final location to prevent return of the blocking element to the initial location.

German P No. 3,337,197 discloses non-refillable valves with a blocking element having at least one flexible arm. German No. '197 is a priority application of U.S. Pat. No. 4,543,980. German '197 also discloses embodiments of non-refillable valves which utilize ball-shaped sealing elements.

British Published patent application No. 2,133,502A and French Published patent application No. 2,536,818 appear to correspond to German 3,337,197.

U.S. Pat. No. 3,704,813 discloses a fluid dispersing valve assembly having a body one end of which is formed for securement to a container. The body forms a conduit having only one through passage for filling and discharging fluid. There is a shut-off valve operable for controlling the flow of fluid through the passage. The shut-off valve has an externally accessible control. There is convertible means in the body comprising an initially inactive check valve initially in condition to accommodate the flow of fluid through the passage in both the filling and discharge directions. The check valve is convertible after an initial filling operation into an active check valve in the passage in series with the shut-off valve. The initially inactive check valve includes a movable valve member, a valve seat, means for biasing the valve member toward the valve seat, and detent means effective initially to prevent the cooperation of the valve member with the valve seat. The detent means is defeatable after an initial filling operation to enable the valve member to engage the seat. The check valve when active is operative to pass fluid only in the discharge direction. The check valve after being rendered active to obstruct the flow of fluid selectively in the filling direction is guarded against access from the exterior of the valve assembly when secured to a container for reopening the passage to the flow of fluid in the filling direction Thereby a container equipped with the valve assembly can be evacuated and then filled with fluid in the initial condition of the valve assembly but is substantially non-refillable after conversion of the convertible means.

U.S. Pat. No. 3,985,332 teaches a non-refillable safety valve for a pressure container. The valve includes a housing, having a central bore, which provides communication between a port and the pressure container for charging and selective discharging the pressure container. The central bore has a lower portion that is narrower than the upper portion of the central bore. A hollow knob unit, having a central bore, is in threaded engagement with the outer wall of the housing. A core, having a central bore, is slidably mounted in the central bore of the housing. The upper end of the hollow knob unit is mounted on the core in a rotatable manner and in fixed longitudinal relationship with the core. A sealing member is slidably mounted in the lower end portion of the central bore of the core. The core contains end stop means for preventing movement of the sealing member below the lower end of the core. The sealing member engages the central bore of the housing when the core is moved the maximum possible distance into the central bore of the core or when refill is attempted after discharge of the pressure container. The core contains at least one passageway located in the core outwards form the sealing member for communication between the central bore of the core and said upper portion of the central core, of the housing. An engagable stop means is positioned between the outer surface of the housing and the inner surface of the hollow knob unit in order to limit retrograde or outward movement of the core to a position whereby the sealing member still engages the interface ledge when refilling the pressure container. The engagable stop means engages after the pressure container has been filled and the sealing member, the core and the knob unit have been moved into sealing position.

U.S. Pat. No. 871,780 teaches a bottle having a neck provided with a passage and having a valve chamber at the inner end of the neck. A valve seat is formed in the chamber. There is a valve operable in the latter and provided with a compressible head adapted to close upon the seat and of greater diameter than the passage. The valve is elastic, and is inserted into the chamber of the bottle by forcing it in deformed shape down the neck of a bottle by means of a mechanism similar to a screw press. The bottle is inserted into the press box and the screw is used to force the deformed valve down the bottle neck. The valve mechanism is used to prevent fraudulent substitution of contents; use with pressurized fluids is not mentioned.

There is a need for a relatively simple and inexpensive valve which will allow normal filling of the pressure container under proper conditions, adequate sealing of the pressure container during nonuse, selective discharge of the pressure container, and effective prevention of improper and unauthorized refilling of the container.

Check valves are old in the art. Concerning the flow of gases, U.S. Pat. No. 2,524,129 discloses a check valve wherein the top outside portion of valve 25 is cylindrical (24) and the bottom outside portion (23) is a truncated cone (with flat end 26). The bottom portion of valve 25 is therefore frustoconical in shape. Valve 25 also has top stem 27. (There are further parts to valve 25.) See the shape of the closure elements in FIGS. 1, 5, 7 and 9 to 11 of British Published Patent Application No. 2,088,317 (published on June 9, 1982) for non-refillable bottle stoppers. FIGS. 1 and 3 of British '317 show a round closure element and the shaped closure element 39 (although it is substantially hollow).

BROAD DESCRIPTION OF THE INVENTION

An object of the invention is to provide a non-refillable valve for compressed gas containers, for example, cylinders. Another object of the invention is to provide a non-refillable valve, once activated, which will move freely to permit discharge of the pressurized fluid and which will move automatically to the closed position for preventing the introduction of fluid into the container. A further object of the invention is to provide a comparatively simple, inexpensive, non-refillable valve, which when initially filled and sealed will permit discharge of the contents of a pressure container, but which will prevent the introduction of further fluid into the container. A still further object of the invention is to provide a non-refillable valve which will prevent refilling of a pressure container even though it is substantially disassembled. Another object of the invention is to provide a non-refillable valve for pressure containers that fulfills the needs of the art regarding such systems. Another object of the invention is to provide a non-refillable valve which is automatically activated in its non-refillable function by placing in its closed position ready for discharge of pressurized fluid from the pressure container it is mounted on. Other objects and advantages of the invention are set out herein or are obvious herefrom to one ordinarily skilled in the art.

The valve of the invention achieves such objects and the invention are set out herein or are obvious herefrom to one ordinarily skilled in the art.

The valve of the invention achieves such objects and advantages.

The invention involves a non-refillable valve for a pressure container which includes a housing. The housing has a central bore which has a lower portion that is narrower than the middle portion of the central bore and which has an upper portion that is narrower than the middle portion of the central bore. A side port is present which communicates with the lower region of the middle portion of the central bore. The lower end of the housing is adapted to sealingly engage the pressure container in a manner which provides communication between the pressure container and the lower portion of the central bore. There is a side or outlet nozzle, having a bore (usually lengthwise) therethrough, which communicates with the atmosphere. The nozzle is positioned on the side of the housing and is in communication with the middle portion of the central bore via the side port in the housing. Valve stem means is positioned in the upper portion of the central bore in a rotatable manner which advances the valve stem means back and/or forth in the central bore. The valve stem contains a centrally-located bore in the bottom portion of the central axis of the upper portion of the central bore. There is also a resilient valve sealing member which has a body portion, and which has a post on pin located on the top of the body portion. The post slidingly engages the bore in the valve stem. The body portion has a top rim portion which has a lateral dimension which is larger than the lateral dimension of the upper portion of the central bore of the housing and which is less than the lateral dimension of the middle portion of the central bore of the housing. The body portion has a bottom seating portion which is capable of seating at or on the interface of said middle portion and bottom portion of said central bore of said housing. The top rim portion does not contain any gaps, slots, indentations or the like. The body portion does not contain any arms, particularly around its periphery. The top rim portion of the sealing member is compressingly positioned in the upper portion of the central bore when the valve is inactive or being filled. The valve sealing member is pushed into the middle portion by means of the valve stem means when the valve is placed in the active position. The valve sealing member is seated against the interface between the middle and lower portions of the central bore when the valve is closed. The sealing member is positioned in the middle chamber above the seating interface when the valve is used for discharge of the container. The sealing member sealingly engages the seating interface when refill of container with pressurized fluid is attempted.

Preferably the pressure container is a pressurized gas container and preferably the pressurized gas container is a pressurized gas cylinder. The valve stem means is preferably mounted in the upper portion of the central bore in a screwable manner. Preferably the valve stem means has an externally-located knob for turning the valve stem means. An O-ring is preferably mounted in a groove in the valve stem means positioned in the upper portion of the central bore and sealingly engages the surface of the upper portion of the central bore. Also, preferably the valve sealing member is made of a resilient plastic. Preferably the bottom rim of the body portion is bevelled.

The valve sealing member of the invention valve is not prevented from seating by any detent which is external to the valve sealing member itself.

In the inactive phase, the valve sealing member is held in the upper portion of the central bore of the valve housing by the means of the compressed, elastic, top rim portion of the valve sealing member. The condition allows the passage, formed by the lower and middle portions of the central bore of the housing and the bore of the outlet nozzle to be used in a filling operation. After the container has been filled and the invention valve is placed in the closed position, the valve sealing member assumes its operative configuration for preventing the flow of fluid into the container in the filling direction. The valve sealing member is virtually inaccessible for tampering to hold it open such as would become necessary for refilling the container.

The invention non-refillable valve does not use any spring means to operate the valve sealing member in any of its functions.

The invention valve has a single line of communication or passageway that serves both for the initial filling operation and subsequently for the controlled discharge of fluid. The valve sealing member is initially not located in that passage. The valve sealing is convertible from an initially inactive condition and location utilized during the initial filling operation into its active configuration and location to block subsequent flow in that passage in the filling direction.

When the invention valve is being closed, thus signalling completion of the filling operation, the invention valve automatically causes the valve system to convert to its non-refillable state. The invention valve has a shut off means that incorporates the valve sealing member to control and/or stop the delivery of fluid from the pressure container.

The invention valve is a non-refillable valve that allows one filling and then selective discharging. The invention valve is designed to prevent, and does prevent, the refilling of a pressure container. In this manner, the invention valve allows actual attainment of governmental requirements for a valve that prevents refilling of certain pressure containers.

The invention valve is effective, but relatively simple, and is inexpensive to construct. The invention valve is fail-proof in the matter of charging, storing and selective discharging. Subsequent filling of the pressure container is prevented by the invention valve.

The non-refillable valve of the invention can be used for fluids, i.e., gases and/or liquids. The fluid can contain solids that are discharged from the pressure vessel as entrained solids, etc. Many forms of liquefiable fluids are sold in disposable containers. Small metal tanks containing liquefied propane, liquefied butane and refrigerants such as FREON are examples. When containers of such type are filled by manufacturer who has full control of the starting condition of the container and of the filling procedures and the specifications, a relatively safe product can be distributed to the public. However, sometimes empty or partly empty containers are collected and these are refilled by poorly skilled and poorly equipped persons. The results is often a hazardous product. The non-refillable valve of the invention prevents such problem and associated dangers.

By way of summary, the invention valve is installed on a cylinder and shipped empty to the filler. Filling the cylinder is achieved by means of a passageway through the spud or other nozzle into the chamber in the valve housing and through the bottom passageway into the pressure cylinder. The sealing member is prevented from moving down by means of the force exerted on its top surface by the compression on the deformed top rim portion of the elastic sealing member. The compression exerted on the sealing member is sufficient to resist the pressure communicating through passage acting to force sealing member downward. The compressive force is such between sealing member and its top surface to maintain the valve to remain in the open position during shipment. Preferably an O-ring seals the top turnable valve stem during filling to prevent any loss of product to the atmosphere during the filling process. Initially, the valve is in its open position. When the stem is turned to close from the open position, sufficient force can be applied forcing the sealing member downward allowing the compressed top rim area of the sealing member to move outward. The sealing member can then be sealed against the valve seat with sufficient load applied by means of the stem to effectively seal the pressurized contents in the cylinder. The diameter difference between the surfaces is large enough that clearance is provided for the free movement of the sealing member. When the stem is turned to open, after filling, the sealing member will move upward due to the pressure of the cylinder contents acting on the lower surface. In this way, contents can be withdrawn from the cylinder. The stem can be turned until the stop is reached of the valve body. The sealing member travel is limited by a bore surface since in the uncompressed condition, the top of the sealing member has an interference in the design such that such surface cannot be diametrically compressed during its upward travel. The sealing member remains concentric by means of the bore within sealing member.

During any attempt to refill the cylinder, the following conditions will occur. Gas would enter the passageway of the spud and enter the central chamber communicating to the upper surface of the valve sealing member forcing it downwardly and sealingly against the surface due to the pressure differential between the chamber and the passage and the cylinder.

The sealing element of the invention does not contain any arms (flexible or otherwise) or any slots which have an opening on the top rim portion. The top rim of the invention sealing arm is not an arm. The invention sealing element is basically a body portion (without any peripheral portions which could be interpreted to be flexible, radially extending arms) with a top-mounted stem.

The non-refillable valves of U.S. Pat. No. 4,573,611 (O'Connor) and U.S. Pat. No. 4,543,980 rely upon valve sealing members (or valve blocking members) which have at least one flexible arm extending from the body element thereof. Such flexible arms represent a potential weakness in such non-refillable valves.

Generally the sealing element of Patent '611 or Patent '980 cannot be returned to its initial position in or above the constriction in the central bore of the valve body. Someone could remove the valve stem and try to pull the sealing element upwards using needle nose pliers or the like by means of the top post on the sealing element. Removal of the valve stem allows the sealing element to be moved off of the vertical axis to try to manipulate one of the arms into the constriction. Regarding Patent '611, someone could insert a rod into the side nozzle and try to push the sealing element upwards by means of leverage pressure or the like. The slots between the arms means that the circumference of the blocking element might be compressed sufficiently by the pushing or pulling pressure. It is unlikely that such attempts would be successful because the upper ends of arms of the blocking element fit against the bottom side of the constriction in the central bore. This potential problem is minimized with the sealing element of the invention because the invention sealing element does not contain any arms on the slots therebetween.

The pushing or pulling force on the sealing element of Patent '611 or Patent '980 during an attempt to force the sealing element into or above the constriction in the central bore may damage the flexible arms or cause the breaking of part or all of one of the flexible arms. Any arm, or portion thereof, broken off could readily prevent the proper operation of the valve. If the sealing element was forced into or above the constriction and the valve was refilled, the broken arm or arm portion could interfere with the complete closure of the valve after usage. The slow leakage of a flammable gas could be extremely dangerous. This potential problem is minimized with the sealing element of the invention because the invention sealing element does not contain any arms or the slots therebetween.

The blocking element of the invention provides substantial performance features over the use of a ball-shaped blocking element. A resilient ball-shaped blocking element is far easier to force up into the constriction.

The absence of any slots in the blocking element results in making the non-refillable valve easier to mold the resilient blocking element. The sealing elements of Patent '611 and Patent '980, which are designed with slots, make it difficult to assure that the flash at the slotted areas can be eliminated. Flash is extruded plastic which could become loose during the operation of the valve, causing interference with the proper function or operation of the valve. Additionally, the flash could possibly fall off and become entrained in the fluid being dispensed and result in a clogged expansion valve of the refrigeration system (for example). The invention blocking part, as designed without slots, allows better control of dimensions of the compression diameter of the sealing element when assembled. The modified sealing element provides an improvement in design during use over the prior art slotted blocking elements.

BRIEF DESCRIPTION OF THE DRAWINGS

The preferred embodiments of the invention are shown in the accompanying drawings.

In the drawings:

FIG. 5 is a perspective view of one version of the valve sealing member of the invention;

FIG. 6 is a perspective view of another version of the valve sealing member of the invention;

FIG. 7 is a perspective view of a further version of the valve sealing member of the invention;

FIG. 8 is a fragmentary cross-sectional view of one version of the side port of the valve of the invention;

FIG. 9 is a fragmentary cross-sectional view of another version of the side port of the valve of the invention.

DETAILED DESCRIPTION OF THE INVENTION

Figure 1:
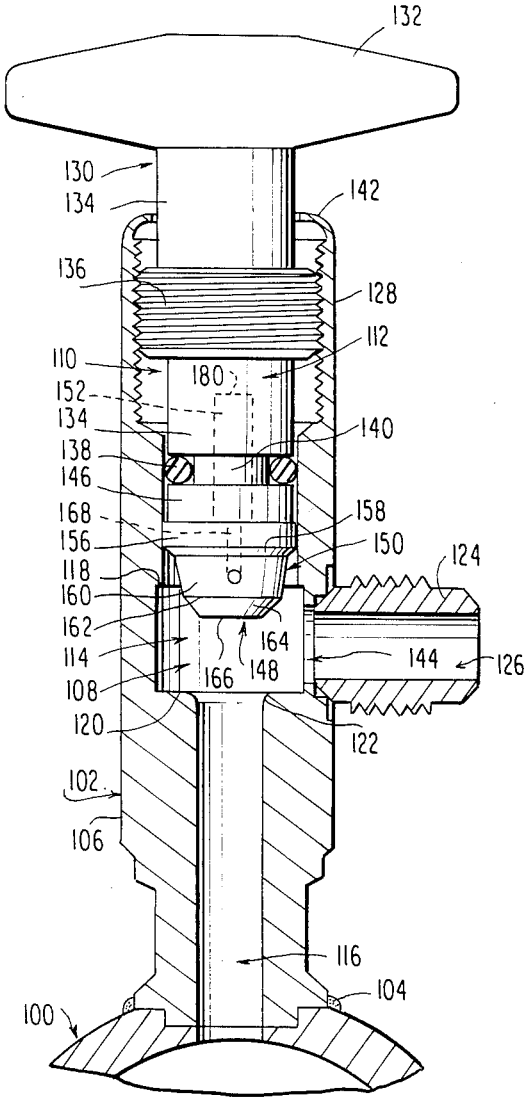
FIG. 1 is a longitudinal cross-sectional view of the non-refillable valve of the invention in its filling position.

Referring to FIG. 1, pressure container or pressure system 100 is provided with non-refillable valve 102 for the filling and selective emptying of container 100. Valve 102 can be welded, threaded or otherwise affixed to container 100, as shown in FIG. 1 at 104 (the welding mode is shown). In FIG. 1 valve 102 is provided with housing 106 which has central bore 108. Central bore 108 communicates with the interior of container 100. Central bore 108 has uppermost portion or chamber 110, upper portion of chamber 112, middle portion or chamber 114 and lower portion or chamber 116. Upper chamber 110 is smaller in diameter than middle chamber 114, and middle chamber 114 is larger in diameter than lower chamber 116. The interface between upper chamber 112 and middle chamber 114 forms flat, horizontal rim 118. The interface between middle rim 114 and lower chamber 116 forms flat, horizontal rim 120. Slightly-rounded edge 122, formed by the interface between flat rim 120 and lower chamber 116, serves a valve seat. Side port 144 of valve housing 106 communicates with middle chamber 114. Side outlet nozzle 124 has lengthwise bore 126. Outlet nozzle 124 is positioned in side port 144 of valve housing 106 so that bore 126 communicates with the lower region of middle chamber 108. Nozzle 124 is preferably externally threaded for attachment to an external source (not shown) of a pressurized fluid, usually a pressurized gas. Any other suitable attachment means can be used to attach the external source of compressed gas to side nozzle 124.

Wall portion 128 of housing 106 encompasses the sides of uppermost chamber 110, which has a diameter that is larger than that of upper chamber 112. Wall portion 128 can be thinner than the rest of housing 106 because it is not subjected to the force caused by the compressed gas. Wall portion 128 is internally threaded. Valve stem 130 has stem 134 and handle 132, which is mounted on the top end of stem 134. Stem 134 is generally positioned in uppermost chamber 110 and upper chamber 112, although lower portion 146 of stem 134 can be positioned in middle chamber 114 when valve stem 130 is screwed downward. The central portion of stem 134 has enlarged portion 136, which is externally threaded and thereby threadingly engages the internally threaded portion of wall portion 128. In this manner and by means of handle 132, stem 134 can be rotatably turned in Central bore 108 so as to advance up or down in uppermost chamber 110 and upper chamber 112. 0-ring 138 is mounted in 0-ring groove 140 located very near the lower end of stem 134. 0-ring 138 can be made of any suitable resilient material, such as, rubber. Upper lip 142 of wall portion 128 is thinner than the internally-threaded portion of wall portion 128. When valve stem 130 is in place in central bore !08, upper lip 142 of wall portion 28 is crimped over as shown in FIG. so as to restrict the upwards movement of enlarged portion 136 of stem !34. Crimped upper lip 142 also prevents the easy removal of valve stem 130 from central bore 108 of housing 106 and provides ease and economy in the manufacture and assembly of valve 102.

While not preferred, different means can be used to retain valve stem 130 in central bore 108. For example, the upper edge of housing 106 can be externally threaded to receive an internally-threaded cap (not shown), which has a central hole therein through which stem 134 fits.

The internally-threaded portion of uppermost chamber 110 has a vertical dimension which is sufficiently short so that O-ring 138 is always in contact with upper chamber 112. O-ring 138 is in compression between the wall of inner chamber 112 and stem 134, thereby providing a hermetic seal between the wall of inner chamber 112 and stem 134 even against pressurized gas.

Figure 2:
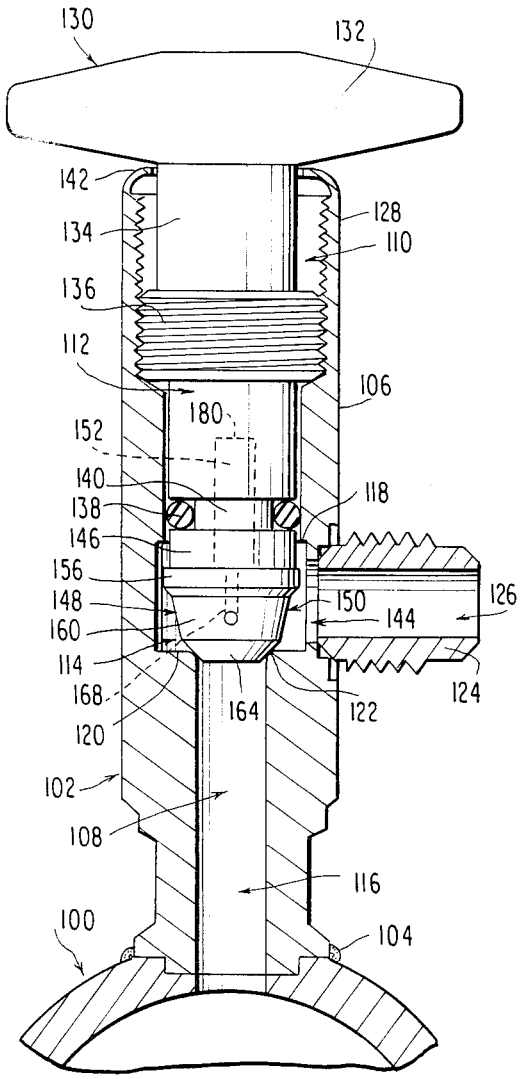
FIG. 2 is a longitudinal cross-section view of the non-refillable valve of the invention in its closed position, ready for use.
Figure 4:
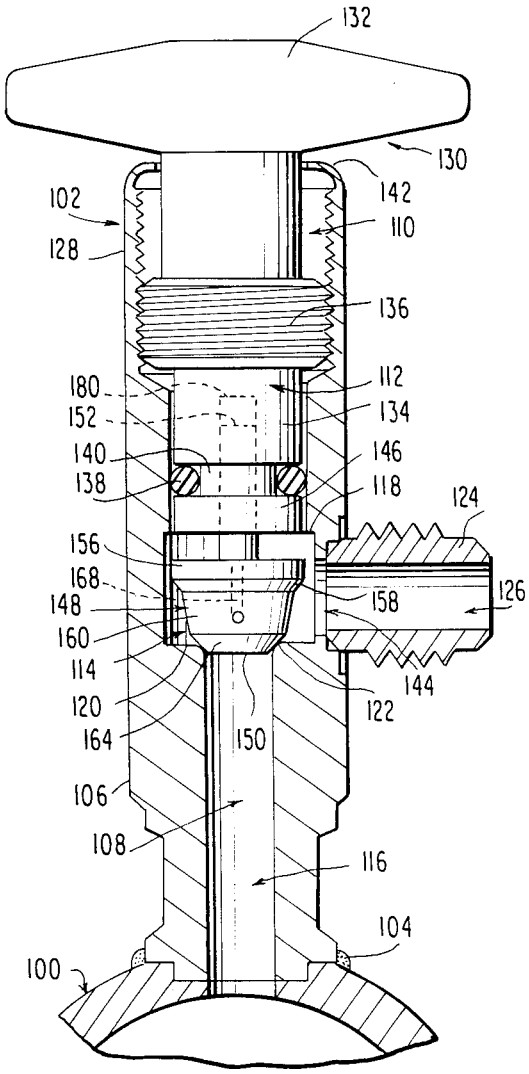
FIG. 4 is a longitudinal cross-sectional view of the non-refillable valve of the invention in its attempted refilling position, after discharge

Referring to FIG. 5, valve sealing member 148 contains body 150 and top post 152. Body 150 contains top surface 154, upon which top post 152 is mounted (but note that valve sealing member is preferably molded as a unitary object). Top surface 154 is preferably flat. Top rim 156 of body 150 has a diameter, when top rim 150 is in a non-compound state, which is slightly less than the diameter of middle chamber 114 of central bore 108 and, when top rim 150 is in a non-compound state, which is slightly larger than the diameter of top chamber 112. Below top rim 156 (which has a vertical face), body 150 has inwardly and downwardly slanted face 158 and then face 160, which is inwardly slanted at a greater downward angle than is face 158 (See FIG. 1.. Edge 162, which is formed by the intersection of face 160 and face 164, is larger in diameter than the diameter of bottom chamber 116. Face or bottom rim 164 of body 150 is bevelled so as to be able to sealingly engage rim 122 (as shown in FIGS. 2 and 4). Bottom surface 166 of body 150 is preferably flat and has a diameter which is less than the diameter of chamber 116.

Top rim 156 fits flush against the wall of upper chamber 112 when valve sealing member 148 is located in compression in upper chamber 112 - see FIG. 1. Top rim 156 preferably has a flat vertical face, but its vertical face can have other shapes, such as, an outward facing angle or curve. The diameter across the top of body 150, when it is in a non-compressed state, is larger than the diameter of upper chamber 112—see FIG. 3.

Figure 3:
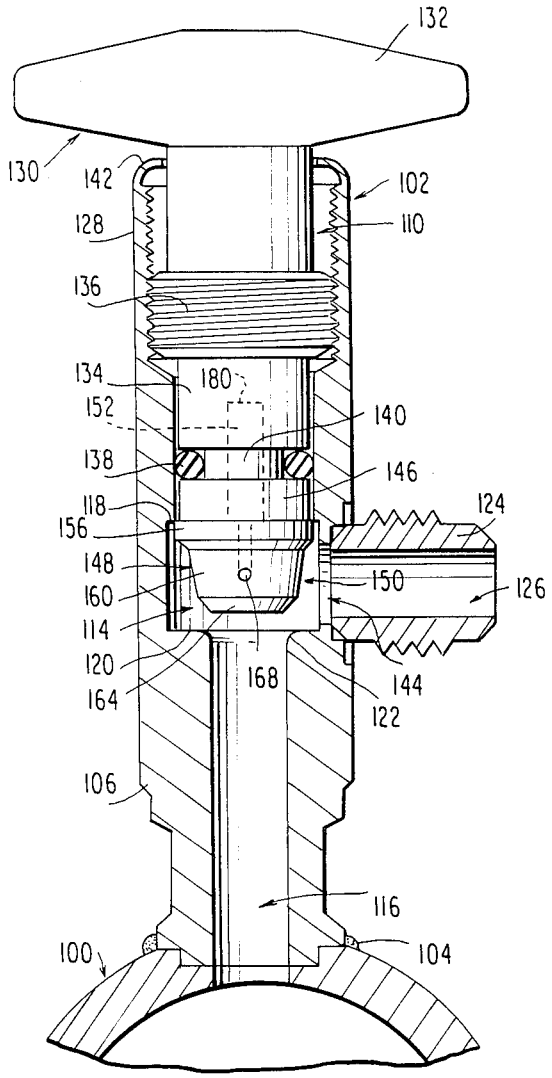
FIG. 3 is a longitudinal cross-sectional view of the non-refillable valve of the invention in its discharge position.

Top pin 152 of slidingly fits in bottom bore 180 of stem 134. Bore 180 is located in the bottom portion of stem 134. Top pin 152 rotatably fits in bore 180 of body 150. The fit of bore 180 and top pin 152 is close but readily allows top pin 152 to travel up and down in bore !80 as shown in FIG. 3. As shown in FIG. 1, bore 180 does not extend all of the up step 134.

Referring to FIG. 6, passageway 168 in body 150 extends from face 160 to top surface 154 of body 150. While the presence of passageway 168 is neither essential nor most preferred in the invention, any entrapped fluid between the top of body 150 and the bottom of stem 134 can readily exit via passageway 168 (as when stem 134 is inserted during assembly of valve 102).

Valve sealing member 148 is made of compressible, but resilient material, or in other words, an elastic material. Valve sealing member 148 is preferably made of a resilient or elastic plastic.

To assemble valve 102, valve sealing member 148 is inserted into uppermost chamber 110 with top pin 152 pointing upwards. Stem 134 is inserted into central bore 108 so that bottom bore 180 fits over top pin or post 152. Valve stem 130 is used to force valve seating member 148 into upper chamber 112. Sealing element 148 is made of a material which is slightly resilient, e.g., a plastic material, which allows such blocking element to be force fit into constriction region 112 in the central valve bore 108. Slanted face 158 helps pass sealing member 148 into upper chamber 112. As sealing member 144 moves into upper chamber 112, the threaded part of expanded portion 136 of stem 134 engages the threaded part of wall portion 128 of housing 106. At this point handle 132 can then be turned to easily force sealing member 148 and 0-ring 138 into upper chamber 112. Expanded portion 136 is moved entirely Within the threaded part of wall portion 128. The various parts are then in the open-valve position shown in FIG. 1. Upper lip 142 is crimped inwardly to seal expanded portion 136 of stem 134 in uppermost chamber 110. In this manner, it is difficult to remove valve sealing member 148 from central bore 108. At this point in time, top rim portion 156 of sealing member 148 is compressed inwardly. As top rim portion 156 is resilient or elastic, top rim portion 148 exerts a force against the surface of upper chamber 112 and thereby prevents sealing member 148 from falling into middle chamber 114 (even if valve 102 is dropped, before being attached to container 100).

In operation, non-refillable valve 102 is initially in the open, ready-for-filling position shown in FIG. 1. The compressed gas flows from its source through bore 126, middle chamber 144, lower chamber 116 and into pressure vessel 100. Once pressure container 100 is filled, knob 132 is screwed inwardly to force sealing member 148 completely into middle chamber 114. In this manner the effect of compressed top rim portion 156 can be overcome. Once sealing member 148 is in middle chamber 114, compressed top rim portion 156 resiliently return to its original non-compressed size (and shape). Since the diameter across top rim portion 156 is greater than the diameter of upper chamber !12, sealing member 148 cannot re-enter upper chamber 112. Any upwards pull on or pressure against sealing member 148 would not cause the re-entry of sealing member 148 into upper chamber 112 (an exceptionally large upwards pulling force would tend to damage top rim portion 156). If valve stem 130 is removed, it is still basically impossible to remove sealing member !48 out of central bore !08. The size of sealing member 148 is made large enough so that it cannot move more than a few degrees from its vertical axis even if valve stem 130 has been removed from central bore 108.

FIG. 2 shows valve 102 in the closed position after container 100 has been filled. To allow the controlled discharge of some of the contents of container 100, knob 132 is screwed outwardly as far as necessary to allow the rate of discharge desired. See FIG. 3. Sealing member 148, via post 152, can freely move up and down in bore 180 when valve stem 130 is in the up or open position. To stop discharge of the contents of container 100, valve screw 13 is screwed downwards to place sealing member 148 back in the closed or sealing position shown in FIG. 2.

After the pressurized gas has been completely discharged from container 100, non-refillable valve 102 automatically prevents any refilling or reuse of container 100. Refilling after the partial discharge of pressurized gas or an attempt to insert a further amount of pressurized gas to an already filled container 100 is automatically prevented by valve sealing element 148. FIG. 4 illustrates how valve 102 prevents refill with pressurized gas. Let us say that valve stem 130 has been screwed outwards as far as it will go. In this position sealing member 148 can freely move up and down in the end of valve stem 130 and in middle chamber 114. Usually container 100 is in an upright position and sealing member 148 is in contact with seat 122. When a person tries to refill container 100, the pressurized gas can readily enter the space above sealing member 148 via passageway 168 and around the edge of top rim 156. Passageway 168 is optional and is not necessary for the operation of the invention. Thereby the force acting on the top of sealing member 148 is greater than the force acting on the bottom of sealing member 148 because the exposed area on top of sealing member 148 is greater than the exposed area on the bottom surfaces of sealing member 148. This keeps sealing member 148 forced against seat 122. Even if container 100 is turned upside down or placed on its side so that sealing member 148 is not in contact with sealing edge 122, a suction is created in middle chamber 114 and bottom chamber 116 by the stream of compressed gas which pulls sealing member 148 against sealing edge 122 when one attempts to refill container 100 via outlet nozzle 124.

Referring to FIG. 4, note that the lower opening of passageway 168 lies above seat 122. Accordingly, passageway 168 cannot be used to slowly refill container 100.

O-ring 132 and sealing member 148 are the only non-metallic parts (possible also knob 132) and they should be made of materials which are chemically resistant to the compressed fluid used in container 100. The rest of the parts of valve 102 should be made of very strong metal, such as, steel. Stainless steel should be used if the pressurized gas is corrosive.

One of the important features of the invention is the location of outlet nozzle 124 (i.e., bore 126) in the lower portion of middle chamber 114 below top rim 156 of sealing member 148 when sealing member 148 is in the fill position (as shown in FIG. 1). In such arrangement, sealing member 148 does not interfere with the compressed gas flow path into container 100 during the filling operation. Of course, this assumes that the height of bottom chamber is of sufficient magnitude to keep bottom surface 166 of sealing member !48 a reasonable distance above seat 122.

When sealing member 148 is seated on rim 122, top surface !54 of sealing member 148 is preferably in the same or just above the longitude plane passing through the top of bore 126 of side nozzle 124. This arrangement easily allows the entering compressed gas to reach the area above sealing member 148.

Bottom surface 166 of sealing member 148 helps to provide a large area on the bottom surfaces of sealing member 148 during discharge. Bottom surface 166 is hidden to gas pressure during any attempt at refilling container 100 once sealing means 148 has seated (due to the larger top surface of sealing means 148 even including the vertical force rector on bevelled surface 164).

Referring to FIG. 7, valve sealing member 182 is an alternative to valve sealing member 148 and is easier to mold. Valve sealing member 182 contains body 184 and top post 186. Body 184 contains top surface 188, upon which post 186 is mounted. Top surface 188 is preferably flat. Top rim 190 of body 184 has a diameter, when top rim is in a non-compressed state, which is slightly less than the diameter of middle chamber 114 of central bore 108 and which is slightly larger than the diameter of top chamber 112. Below top rim 188 (which has a vertical face), body 184 has inwardly and downwardly slanted face 192. Edge 194, which is formed by the intersection of face 192 and face 196, is larger in diameter than thee diameter of bottom chamber 116. Face or bottom rim 196 of body 184 is bevelled so as to be able to sealingly engage rim 122. Bottom surface 198 of body 184 is preferably flat and has a diameter which is less than the diameter of chamber 116. Optional passageway 200 in body 184 extends from face 192 to top surface 188.

FIG. 8 shows a very preferred embodiment of side outlet nozzle 124 (which is the embodiment shown in FIGS. 1 to 4). Side port 148 is located in the bottom of middle chamber 114. Side Port 148 has stepped portions 172, 174 and 176, each having a larger diameter than the next inwardly stepped portion. Side outlet nozzle 124 contains horizontal bore 126, which communicates with middle chamber 114 via stop portion 176 of side port 148. The end (180) of nozzle 124 is bevelled. The diameter of nozzle 124 is such that it snugly fits within middle step portion 174 with bevel 180 not extending past the interface of step portion 174 and 176. Nozzle 124 can be welded to housing 106 utilizing the ring groove formed by step portion around nozzle 124.

FIG. 9 shows side outlet nozzle 168 formed as a unitary part of housing 106. Side outlet nozzle 168 contains horizontal bore 170.

The use of separate outlet nozzle 124 provides increased ease of manufacture and assembly and increased costs savings over the embodiment shown in FIG. 9.

Although the invention non-refillable valve has been primarily described above for compressed gas containers, the invention non-refillable valve can be used with pressure fluid containers, such as, pressurized liquid containers.

The valve and blocking element are configured such that the blocking element can be irreversibly moved to a position in which the valve permits escape of fluid under pressure exerted from the inside of the container, but which automatically closes in response to exposure to an external pressure greater than the pressure inside the container. The valve itself is formed of a valve housing, and a stem to open and close the valve. The stem is configured to force the blocking element from the initial to the final location.

The material out of which the blocking element is made is not critical, although it must be sufficiently flexible so as to allow for compression of flexion while in the constricted portion, and then re-expansion when finally positioned in the final location. Resilient plastics are preferred, provided such plastics are inert to the pressurized gas used in the container.

The invention valve does not encompass the valve entry side port being located above the constricted portion of the valve control bore where the sealing element does not contain any bypass holes. The use of the invention valve with a top side port (with sealing elements which do not contain any bypass holes) would be inoperable because the sealing element is initially in the compressed state in the constricted region of the valve central bore and, therefore, the container could not be filled. The pressurized gas would have no unblocked path from the upper located side port into the container. If the pressurized gas forced the compressed blocking element out of the constricted region, initial filling would then be blocked. (The use of a sealing element with at least one bypass hole, i.e., which is not a slot and which does not extend into the seating portion of the sealing element, would be a very impractical embodiment because filling would be very slow unless the holes were relatively quite large.)

Some of the advantages of the invention valve over the top part embodiments of U.S. Pat. No. 4,543,980 are discussed herein. The following are some of the advantages of the invention approach of using a side port located below the blocking element during filling:

1. The overall height is approximately the same as current standard valves in use. This is important to avoid the redesign of handles and cartons, and avoids increased cost regarding such matter.

2. The top port design of Patent '980 by its nature restricts the flow during filling and increase the costs to fill the cylinder - this is not a problem with the invention valve.

In every specific embodiment, valve of Patent '980 accomplishes fill through an entrance port which is always above the blocking element. Even in the description of FIG. 3, the entrance of filling takes places above the blocking element. The disadvantage of this arrangement occurs because the flow of the filling gas must pas around the outer perimeter or through the vanes of the blocking element, and when the cylinder discharges, gas flow is through the vanes. Use of the invention closure element in the drawings of Patent '980 would prevent filling (unless the top post of the closure element was force fit, for example, into the vertical passageway in the valve stem).

Concerning the invention valve:

1. The blocking element of the invention valve is above the filling port during the filling operation providing unrestricted flow.

2. The design by its nature allows for a minimum height without redesign of the container handles or cartons and the manufacture of the valve.

3. The valve design is such that during the discharge of the cylinder the flow is less restricted allowing maximum discharge rate as opposed to the Van der Sanden valve.

4. It is obvious when the benefits of fill rate, economics, and ability to provide the industry with a valve without handle or carton redesign that the invention valve is substantially distinct from the valve of Patent '980.

The disclosure of Patent '980 is not limited to a blocking element having a top post which slidably fits into the valve stem. FIG. 7 thereof shows a blocking element with flexible arms and without a top post, but the stabilizing effect of the top post is replaced with a bottom hollow rod (which slides in the bottom chamber of the valve central bore). Such embodiment still requires flexible arms.

Although the invention has been described with reference to some preferred embodiments it is not intended that the broad scope of the herein-described non-refillable valve of the invention be limited thereby but that some modifications and variations are intended to be included within the spirit and scope of the invention as defined by the following claims.

What is claimed is:

1. Non-refillable valve for a pressure container, comprising:

(a) a housing, having a central bore which has a lower portion that is narrower than the middle portion of said central bore and which has an upper portion that is narrower than the middle portion of said central bore, and having a side port which communicates with the lower region of said middle portion of said central bore, the lower end of said housing being adapted to sealingly engage said pressure container in a manner which provides communication between said pressure container interior and the contents therein and said lower portion of said central bore;

(b) a nozzle, having a bore therein which communicates with the atmosphere, said nozzle being positioned on the side of said housing and being in communication with said middle portion of said central bore via said side port in said housing;

(c) valve stem means positioned in said upper portion of said central bore in a rotatable manner which advances the valve stem means back and/or forth in said central bore, said valve stem having a threadable connection with said upper portion of said central bore, said valve stem means containing a centrally-located bore in the bottom portion thereof, the central axis of said bore being coaxial with the central axis of said upper portion of said central bore of said housing; and (d) a resilient valve sealing member which has a body portion and which has a post positioned on the top of said body portion, said post slidingly engaging said bore in said valve stem means, said body portion having a top rim portion which has a lateral dimension which is larger than the lateral dimension of said upper portion of said central bore of said housing and which is less than the lateral dimension of the middle portion of said central bore of said housing, said body portion having a bottom seating portion which is capable of seating at or on the interface of said middle portion and bottom portion of said central bore of said housing, said top rim portion being continuous such that it does not contain any indentations, slots, or gaps, and said body portion not containing any arms, said to rim portion of said sealing member being compressingly positioned in said upper portion of said central bore when said valve is inactive or being filled, said valve sealing member being pushed into said middle portion by means of said valve stem means when said valve is placed in the active position, said valve sealing member being seated against said interface between said middle and lower portions of said central bore when said valve is closed, said sealing member being positioned in said middle chamber above a said seating interface when said valve is used for discharge of said container contents, and said sealing member sealingly engaging said seating interface when refill of said container with pressurized fluid is attempted.

2. Non-refillable valve as claimed in claim 1 wherein said bore in said nozzle runs lengthwise through said nozzle.

3. Non-refillable valve as claimed in claim 1 wherein said nozzle is positioned in said side port in said housing.

4. Non-refillable valve as claimed in claim 1 wherein said valve stem means is mounted in said upper portion of said central bore in a screwable manner.

5. Non-refillable valve as claimed in claim 1 wherein said valve stem means has an externally-located knob for turning said valve stem means.

6. Non-refillable valve as claimed in claim 1 wherein an O-ring is mounted in a groove in the valve stem means positioned in said upper portion of said central bore and sealingly engages the surface of said upper portion of said central bore.

7. Non-refillable valve as claimed in claim 1 wherein said valve sealing member is made of a resilient plastic.

8. Non-refillable valve as claimed in claim 1 wherein the bottom rim of the body portion is bevelled.

9. Non-refillable valve as claimed in claim 1 wherein said bore in said nozzle runs lengthwise through said nozzle, said nozzle is positioned in said side port in said housing, said pressure container is a pressurized gas container, an O-ring is mounted in a groove in the valve stem means positioned in said upper portion of said central bore and sealingly engages the surface of said upper portion of the central bore, said valve sealing member is made of a resilient plastic, and the bottom rim of the body portion is bevelled.

10. Non-refillable valve as claimed in claim 1 wherein said pressure container is a pressurized gas container.

11. Non-refillable valve as claimed in claim 10 wherein said pressurized gas container is a pressurized gas cylinder.

* * * * *